US005375670A

United States Patent [19]

Ekwall et al.

[11] Patent Number: 5,375,670

[45] Date of Patent: Dec. 27, 1994

[54] DRILL STRING COMPONENT FOR DRILLING WITH A LIQUID DRIVEN DRILLING MACHINE

[75] Inventors: Berndt Ekwall, Saltsjöbaden; Martin Peterson, Nacka; Kurt Andersson, Tyresö, all of Sweden

[73] Assignee: Atlas Copco Rocktech AB, Stockholm, Sweden

[21] Appl. No.: 58,645

[22] Filed: May 7, 1993

[30] Foreign Application Priority Data

May 19, 1992 [SE] Sweden ..... 9201562-7

[51] Int. Cl.[5] ..... F21B 17/07; F21B 17/18

[52] U.S. Cl. ..... 175/215; 175/322

[58] Field of Search ..... 175/215, 321, 322, 296

[56] References Cited

U.S. PATENT DOCUMENTS 1,891,416 12/1932 Harris ..... 175/321 X
1,897,121 2/1933 Harris ..... 175/321 X
3,664,443 5/1972 Campbell ..... 175/321 X
4,991,669 2/1991 Anderson ..... 175/215 X

FOREIGN PATENT DOCUMENTS 3015695 10/1981 Germany .

*Primary Examiner*—David J. Bagnell
*Attorney, Agent, or Firm*—Mark P. Stone

[57] ABSTRACT

Drill string component for use at drilling with a liquid driven down-the-hole drilling machine (1) comprising three coaxial tubes (2,4,6) for forming channels for supply of driving medium to the down-the-hole drilling machine, return of the driving medium after it has done its work and supply of flushing medium to the bore hole. The outer tube (2) of the drill string component is provided with a first end piece (7) which is axially displaceable relative to the outer tube and axially lockable relative to the outer tube in an outer position so that the inner tubes (4,6) are protected against damage when the drill string component is not connected with another drill string component, the hammer device (1) or a rotary device (9) for rotation of the drill string.

3 Claims, 1 Drawing Sheet

DRILL STRING COMPONENT FOR DRILLING WITH A LIQUID DRIVEN DRILLING MACHINE

BACKGROUND OF THE INVENTION

The present invention relates to a drill string component for use at drilling with a liquid driven down-the-hole drilling machine.

In a prior art drill string component of the above mentioned kind, DE-A-30 15 695, the drill string component is provided with coaxial tubes in order to form three coaxial channels for conducting driving liquid to and from the down-the-hole drilling machine and for conducting flushing medium, air or water, to the drill bit for flushing of the drill hole. A drawback with this solution is that the two inner tubes which protrude from the outer tube in order to sealingly cooperate with the corresponding tubes of an adjacent drill string component easily can be damaged when the drill string component is mounted in a drill string or when the drill string component is transported. Furthermore, it is easy to damage the inner tubes when the drill string component is connected to another drill string component, hammer device or rotary device because one must first push the inner tubes into the adjacent component and only then screw the outer tubes together.

SUMMARY OF THE INVENTION

The present invention, which is defined in the subsequent claims, aims at decreasing the above mentioned problem by arranging it so that the inner tubes do not protrude from the outer tube when the drill string component is not mounted in a drill string and arranging it so that the drill string component is guided into the drill string by the thread of the outer tube before the inner tubes are pushed into the corresponding tubes in the adjacent component in the drill string.

BRIEF DESCRIPTION OF THE DRAWING

An embodiment of the invention is described below with reference to the accompanying drawing in which.

DESCRIPTION OF THE PREFERRED EMBODIMENT OF THE INVENTION

Figure 1:
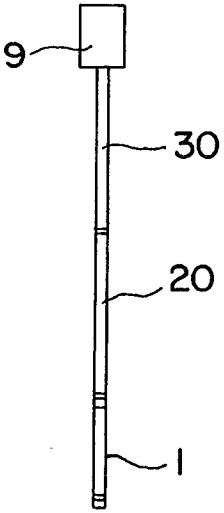
FIG. 1 shows a drilling device comprising a rotary device, two drill string components according to the invention and a down-the-hole drilling machine.

The drilling device shown in FIG. 1 comprises a liquid driven down-the-hole drilling machine 1, two drill string components 20,30 and a rotary device 9 for rotation of the drill string. The drill string can, of course, contain an arbitrary number of drill string components.

Figure 2:
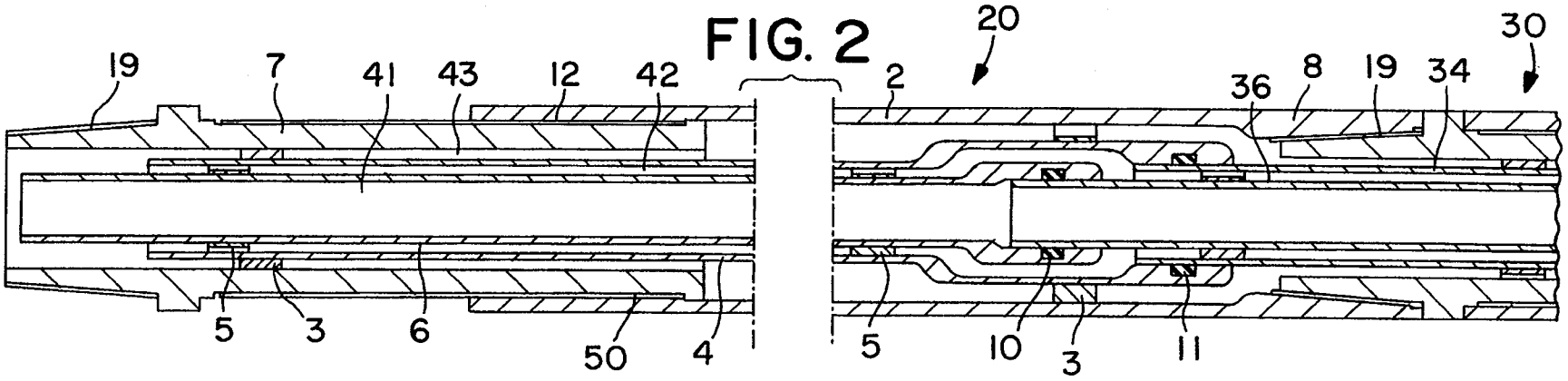
FIG. 2 shows a longitudinal section through a drill string component according to the invention and partly through an adjacent drill string component.

Drill string component 20 comprises an outer tube 2 in which an intermediate tube 4 is guided by means of spacers 3. An inner tube 6 is by means of spacers 5 guided in the intermediate tube 4. The three tubes define three channels 41, 42 and 43. These can for example be used in the following way. Channel 41 is used for supply of pressure liquid to the down-the-hole drilling machine 1. Channel 42 is used for transport of liquid after the liquid has done its work in the down-the-hole drilling machine. Channel 43 is used for supplying flushing medium, air or water, to the drill bit for flushing the bore hole. Inner tube 6 and intermediate tube 4 are at the right end of FIG. 2 provided with seals 10 and 11 respectively for sealing cooperation with inner tube 36 and intermediate tube 34 in the adjacent drill string component 30. Corresponding cooperation exists also between rotary device 9 and down-the-hole drilling machine 1 respectively and the adjacent drill string component.

Figure 3:
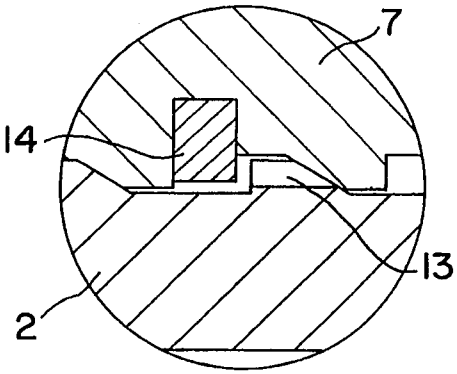
FIG. 3 shows a detail of the device according to FIG. 2.
Figure 4:
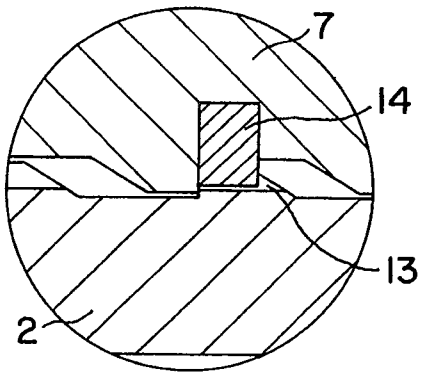
FIG. 4 shows the detail according to FIG. 3 with the included parts in another relative position.

Outer tube 2 is provided with a first end piece 7 and a second end piece 8. The first end piece is by means of a threaded connection 12 axially movable relative to outer tube 2 between an inner position, shown for drill string component 30, and an outer position, shown for chill string component 20. By tightening the threaded connection in either direction axial locking of the first end piece relative to the outer tube is obtained. Through this, end piece 7 will protect inner tube 6 and intermediate tube 4 when the drill string component is not screwed into a drill string. First end piece 7 is provided with a thread 19 for connection of the drill string component with an adjacent drill string component, the rotary device or the down-the-hole drilling machine. As is shown in FIGS. 3 and 4 first end piece 7 is provided with projections 14 and the outer tube 2 with grooves 13.

These are positioned at about the position marked by the reference numeral 50 in FIG. 2. As is shown in FIGS. 3 and 4, threaded connection 12 is made such that one has a certain axial movability between first end piece 7 and outer tube 2. In the position shown in FIG. 3, the first end piece is displaced towards its outer position. In this position the first end piece is turnable relative to the outer tube so that the threaded connection 12 can be tightened by means of the rotary device 9. In the position shown in FIG. 4, first end piece 7 is displaced towards its inner position. In this position projection 14 is pushed into groove 13 so that the first end piece and the outer tube are nonturnably coupled to each other so that thread 19 can be screwed into an adjacent drill string component, the rotary device or the down-the-hole drilling machine by rotary device 9.

In the shown example tubes 4 and 6, are axially fixed relative to tube 2 so that the first end piece 7 functions as protection for tubes 4 and 6. It is, of course, also possible to fix tubes 4 and 6 axially relative to the first end piece 7 so that the second end piece 8 functions as protection for tubes 4 and 6. It should also be possible to arrange the tubes such relative to each other that both end pieces function as protection for the two inner tubes when the drill string component is not situated in a drill string. In the shown example one has a threaded connection between the first end piece 7 and outer tube 2. This threaded connection can be replaced by any guide which allows that the first end piece and the outer tube in some position are nonturnably coupled with each other so that the drill string component can be connected with an adjacent drill string component before the inner tubes are moved into the corresponding tubes of the adjacent component. The connection of the outer tubes hereby forms a guide for the moving together of the inner tubes. In addition the first end piece and the outer tube must be axially lockable relative to each other so that the inner tubes remain protected when the drill string component is not situated in a drill string.

The shown device works in the following way when a drill string component is added to the drill string. The thread 19 arranged at the left end of FIG. 2 is moved into an adjacent component. After that the drill string component is pushed to the left so that the first end piece 7 and the outer tube 2 take the relative positions shown in FIG. 4. The first end piece and the outer tube are hereby nonturnably coupled with each other so that the thread 19 is tightened to the adjacent component by means of the rotary device 9. The drill string component is then drawn to the right so that the first end piece 7 and the outer tube 2 take the relative positions shown in FIG. 3. Rotation of the rotary device 9 hereby results in the tightening of threaded connection 12. During this tightening the two inner tubes are guided into the corresponding tubes of the other component for sealing cooperation with these tubes.

We claim:

1. Drill string component for drilling with a liquid driven down-the-hole drilling machine including a hammer device (1) comprising an outer tube (2), an intermediate tube (4) guided in said outer tube by spacers (3), an inner tube (6) guided in said intermediate tube by spacers (5), said outer tube being provided with a first (7) and a second (8) end piece at its end for connection of the drill string component (20) to other of said drill string components (30) or to said hammer device (1) or to a rotary device (9), and the drill string component (20) comprises seals (10, 11) for sealing connection of said intermediate and inner tubes (4, 6) to intermediate and inner tubes (34, 36) of an adjacent one of said other drill string components (30) or to said hammer device (1) or to said rotary device (9), characterized in that said first (7) of the end pieces of the outer tube is connected to the outer tube (2) by a coupling (12) which allows axial displacement of the first end piece (7) relative to the outer tube (2) between an inner position and an outer position, and that the first end piece and the outer tube in one relative position are nonturnably connected to each other and that the first end piece is axially lockable relative to the outer tube so that either of said first and second end pieces protects the ends of the intermediate and inner tubes when the first end piece is at said outer position.

2. Drill string component according to claim 1, characterized in that said coupling comprises a threaded connection (12) and that the outer tube (2) is provided with grooves (13) for cooperation with projections (14) on the first end piece (7) adjacent to an inner end of the outer tube, wherein axial displacement of the first end piece relative to the outer tube results in said nonturnable connection between the first end piece and the outer tube.

3. Drill string component according to claim 2, characterized in that said first end piece (7) is provided with a thread 19 for connection of the drill string component to said adjacent drill string component or said hammer device (1) or said rotary device (9), wherein displacement of the first end piece (7) in a direction towards said inner position results in said nonturnable coupling between the first end piece (7) and the outer tube (2) so that the drill string component (20), by means of rotation of said rotary device (9), is connectable to said adjacent drill string component or said hammer device (1) or the rotary device (9), and after displacement of the first end piece in a direction towards said outer position, said threaded connection (12) is tightenable by said rotary device.

* * * * *